United States Patent [19]

Asari et al.

[11] Patent Number: 4,463,589

[45] Date of Patent: Aug. 7, 1984

[54] INDIRECT EXTRUSION PRESS

[75] Inventors: Akira Asari, Osaka; Tatsuhiko Noyori, Kobe; Takahisa Tabuchi, Kobe; Tsuneharu Masuda, Kobe; Masao Mizoguchi, Shimonoseki; Tetsuro Takehata, deceased, late of Osaka, by Akemi Takehata, legal representative, all of Japan

[73] Assignee: Kabushiki Kaisha Kobe Seiko Sho, Kobe, Japan

[21] Appl. No.: 374,733

[22] Filed: May 4, 1982

[30] Foreign Application Priority Data

Aug. 22, 1981 [JP] Japan ..... 56-125003
Mar. 1, 1982 [JP] Japan ..... 57-29384

[51] Int. Cl.[3] ..... B21C 33/00; B21C 35/06

[52] U.S. Cl. ..... 72/273.5; 72/263; 72/270

[58] Field of Search ..... 72/255, 263, 273, 273.5

[56] References Cited

U.S. PATENT DOCUMENTS

| | | | |
|---|---|---|---|
| 1,609,988 | 12/1926 | Bull | 72/255 |
| 3,314,267 | 4/1967 | Kent et al. | 72/263 |
| 3,530,702 | 9/1970 | De Ridder | 72/255 |
| 4,048,832 | 9/1977 | Raab et al. | 72/255 |
| 4,154,081 | 5/1979 | Boshold | 72/263 |
| 4,379,398 | 4/1983 | Asari et al. | 72/255 |

FOREIGN PATENT DOCUMENTS

| | | | |
|---|---|---|---|
| 2237276 | 2/1973 | Fed. Rep. of Germany | 72/273.5 |

*Primary Examiner*—Lowell A. Larson
*Attorney, Agent, or Firm*—Oblon, Fisher, Spivak, McClelland & Maier

[57] ABSTRACT

An indirect extrusion press including a die assembly having a loose die detachably mounted on a die stem and axially movable relative to a billet container for extruding a billet through a die hole, and a die handling mechanism for transferring the die assembly between the press center and a position outside the press machine, the indirect extrusion press including a reduced diameter portion provided in the rear end portion of the die stem and defining a stepped wall portion; a loose die detachably mounted on the end face of the reduced diameter portion; and a detachable cleaning ring loosely fitted on the reduced diameter portion of the die stem in abutting engagement with the stepped wall portion and in axially spaced relation with the loose die, the cleaning ring being in sliding engagement with the inner periphery of the billet container in the extruding phase of the press operation to remove container shells. The press may further include as part of the die handling mechanism a chuck member for releasably gripping the loose die and cleaning ring and movable for transferring the die and ring in spaced relation between the press center and a retracted position outside the press machine, and a knocking member movable into the space between the loose die and cleaning ring at the retracted position to knock off container shells from a gap between the loose die and the cleaning ring.

7 Claims, 40 Drawing Figures

INDIRECT EXTRUSION PRESS

BACKGROUND OF THE INVENTION (1) Field of the Invention

This invention relates to indirect extrusion presses, and more particularly to an indirect extrusion press which employs a combination of a loose die and a cleaning mechanism for scraping off shells from inner surfaces of a container during extrusion of a material through the die and which permits repeated use of one and same die in the successive extruding cycles by cooperative operations of a die handling mechanism and a discard billet shearing mechanism.

(2) Description of the Prior Art

There is illustrated in FIG. 1 a typical example of the conventional indirect extrusion press, which has a die 2 assembly consisting of a die and a die holder detachably mounted on a die stem 1 and moved relative to and in a billet receptacle bore 4 of a container 3 loaded with a billet A, thereby extruding a product 5 of a predetermined shape. Upon completion of an extruding cycle, a discard billet stub 6 which remains at the tail end of the extrudate 5 at the fore end of the container 3 is cut off by a discard shear mechanism 7.

FIGS. 1(*a*) to 1(*h*) show the successive phases of the extruding operation by the conventional indirect extrusion press. In the initial stage of the operation, a billet A and a die assembly 2 are inserted side-by-side into the billet receptacle bore 4 of the container 3 as shown at (a) and (b) shown in FIG. 1. In the next phase of FIG. 1(*c*), the billet A is sandwiched between a dummy block 8 and the die assembly 2 in axial alignment therewith, and a mandrel 10, mounted in a pressing stem 9, protrudes into the billet A until the mandrel tip opposingly faces the die hole of the die assembly 2 in small gap relation therewith to complete piercing of the billet A. Then, as shown at (d) and (e) of FIG. 1, the billet A is extruded into a tubular form 5 through the die hole, sending forward the extruded product through die stem bore 11 of the die stem 1. Upon completion of the extrusion, the die assembly 2 is supported by an intermediate frame 12 as shown at (f) of FIG. 1, and the discard billet stub 6 and dummy block 8 are gripped by a chuck mechanism 13. In synchronism with the shearing action of the discard shear mechanism 7 against the discard billet 6, the chuck mechanism 13 is retracted to remove the billet stub 6 from the extrudate 5. Thereafter, the extrudate 5 is drawn out of the press machine of the die assembly 2 is transferred to a position outside the machine, while the container 3 and pressing stem 9 are returned to the respective initial positions as shown at (g) and (h) of FIG. 1.

In the indirect metal extrusion, especially in the extrusion of a high tensile aluminum alloy, it is necessary to remove shells which deposit on the inner surfaces of the container, for ensuring a satisfactory surface quality of the extrudate. This has heretofore been accomplished by backstroking through the container a dummy block or a die which is provided with a cleaning edge around the circumference thereof or which has a cleaning disc attached thereto, subsequent to the billet extruding phase. In this connection, it has also been known to use a loose die with a cleaning flange around its rear edge to complete the shell removal simultaneously with the billet extrusion. In any case, a problem is encountered either in that the time of each cycle of press operation is prolonged by the shell-removing operation or in that a number of dies or die assemblies have to be provided due to difficulty of cleaning a used die or die assembly during a dry cycle of the press operation. Therefore, it has been required to provide complicated and costly equipment for cleaning and circulating a number of dies one after another in relation with the cycle of the press operation. The use of a number of dies gives rise to another problem that a very severe tolerance has to be observed in the fabrication process of the die assemblies to ensure dimensional uniformity of extruded products.

A further problem which is encountered in the indirect extrusion by the conventional press is that the discard billet stub is subject to deformation in the shearing stage, making it difficult to grip it securely by the chuck mechanism 13. In this connection, FIGS. 2 and 3 show another conventional indirect extrusion press, in which a discard billet stub is cut off from an extrudate by exposing the discard stub 6 from a container 3 with a die assembly 2 still in a billet receptacle bore 4 of a container 3 as shown particularly in FIG. 3. This sort of extrusion press also involves the problem that billet receptacle bore 4 is susceptible to deformations or other damage by the great load which is imposed on the container in the discard shearing stage.

SUMMARY OF THE INVENTION

It is therefore an object of the present invention to provide an indirect extrusion press which will overcome the above-mentioned problems or difficulties of the conventional presses. A more particular object of the present invention is to provide an indirect extrusion press employing a loose die and a separate cleaning ring which can be easily dismantled and mounted to permit removal of the container shell and cleaning of the die assembly during a dry cycle of the extruding operation.

It is another object of the present invention to provide an indirect extrusion press further employing a die handling mechanism which is arranged to temporarily dismantle and retract the die to a position outside the press machine for removal of the container shells and necessary cleaning during a dry cycle of the extruding operation, thereby permitting use of the same die repeatedly in the succeeding extruding operations.

According to the present invention, there is provided an indirect extrusion press including a die assembly having a loose die detachably mounted on a die stem and axially movable relative to a billet container for extruding a billet through a die hole, and a die handling mechanism for transferring the die assembly between the press center and a retracted position outside the press machine, the indirect extrusion press comprising: a reduced diameter portion provided in the rear end portion of the die stem and defining a stepped wall portion; a loose die detachably mounted on the end face of the reduced diameter portion; and a cleaning ring loosely fitted on the reduced diameter portion of the die stem in abutting engagement with the stepped wall portion and in axially spaced relation with the loose die, the cleaning ring being in sliding engagement with the inner wall surfaces of the billet container in the extruding phase of the press machine to remove container shells therefrom. The die handling mechanism of the press may include a chuck mechanism for releasably gripping the loose die and cleaning ring, which is movable for transferring the die and ring in spaced relation between the press center and the retracted position outside the press machine, and a knocking member movable into the space between the loose die and cleaning ring at the retracted position to knock off the container shells from the cleaning ring.

The above and other objects, features and advantages of the present invention will become apparent from the following description and the appended claims, taken in conjunction with the accompanying drawings which show by way of example preferred embodiments of the present invention and in which like component parts are designated by like reference numerals or characters throughout various figures.

BRIEF DESCRIPTION OF THE DRAWINGS

In the accompanying drawings:

FIGS. 15 to 17 are schematic illustrations showing operations in the first stage of the press cycle, of which FIG. 15 is a view taken in the direction of arrows A—A of FIG. 14, FIG. 16 is a sectioned bottom view and FIG. 17 is a plan view of the press machine;

FIGS. 18 and 19 are schematic illustrations of the operations in the second stage of the press cycle, of which FIG. 18 is a view taken in the direction of arrow B—B of FIG. 14 and FIG. 19 is a sectioned bottom view of the press of FIG. 18;

FIGS. 20 and 21 are schematic illustrations of the operations in the third stage of the press cycle, of which, FIG. 20 is a view taken in the direction of arrows B—B of FIG. 14 and FIG. 21 is a sectioned bottom view of the press of FIG. 20;

FIGS. 23 to 25 are schematic illustrations of the operations in the fifth stage of the press cycle, of which FIG. 23 is a view taken in the direction of arrow A—A of FIG. 14, FIG. 24 is a sectioned bottom view of the press of FIG. 23 and FIG. 25 is an enlarged view showing primary components in FIG. 14;

DETAILED DESCRIPTION OF THE PREFERRED EMBODIMENTS

Figure 1A:
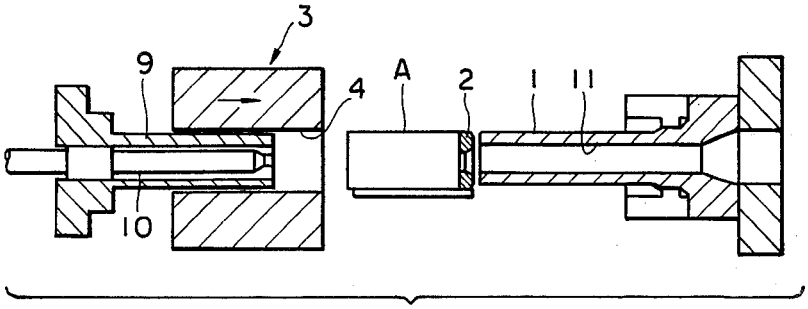
FIGURE. 1(a) PRIOR ART
FIG. 1 is a schematic illustration of an operation by a conventional indirect extrusion press.
Figure 1B:
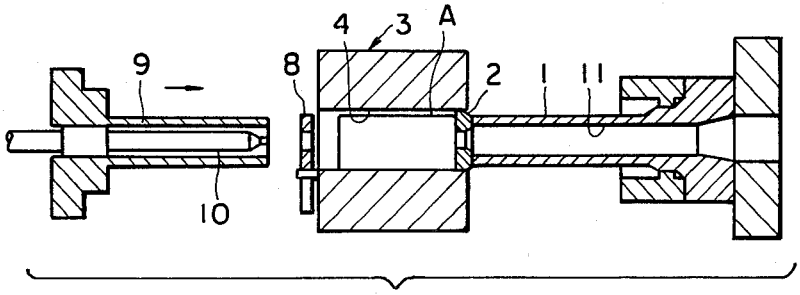
FIGURE. 1(b) PRIOR ART
Figure 1C:
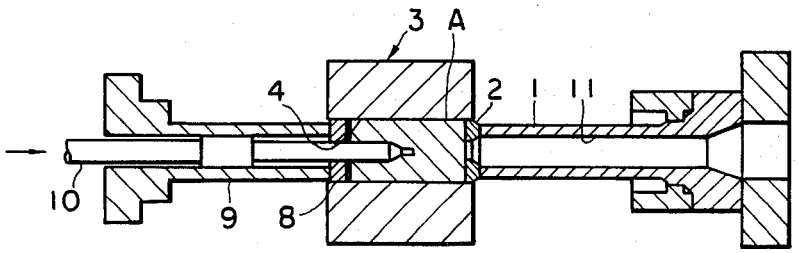
FIGURE. 1(c) PRIOR ART
Figure 1D:
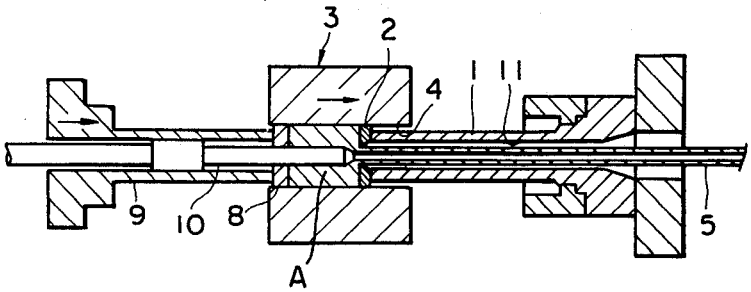
FIGURE. 1(d) PRIOR ART
Figure 1E:
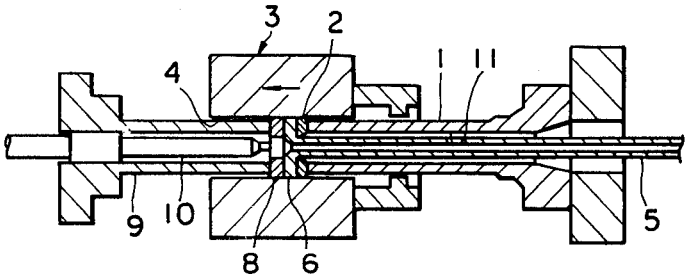
FIGURE. 1(e) PRIOR ART
Figure 1F:
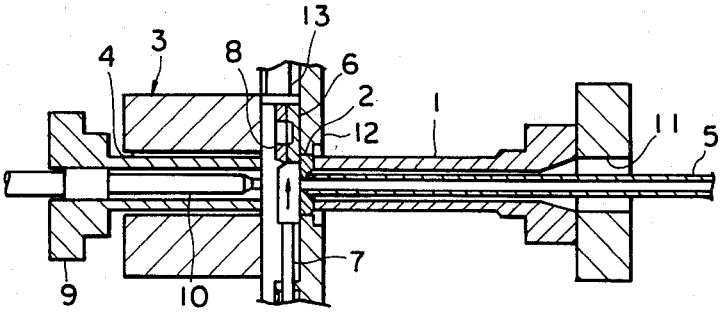
FIGURE. 1(f) PRIOR ART
Figure 1G:
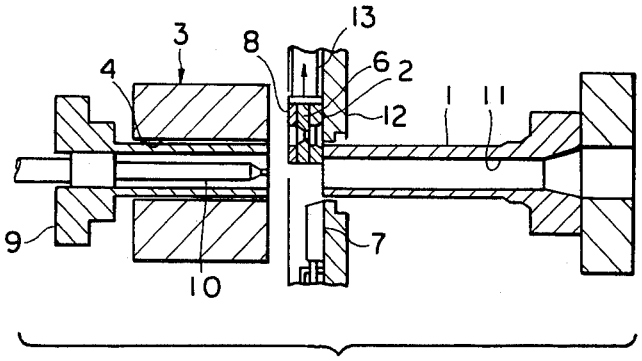
FIGURE. 1(g) PRIOR ART
Figure 1H:
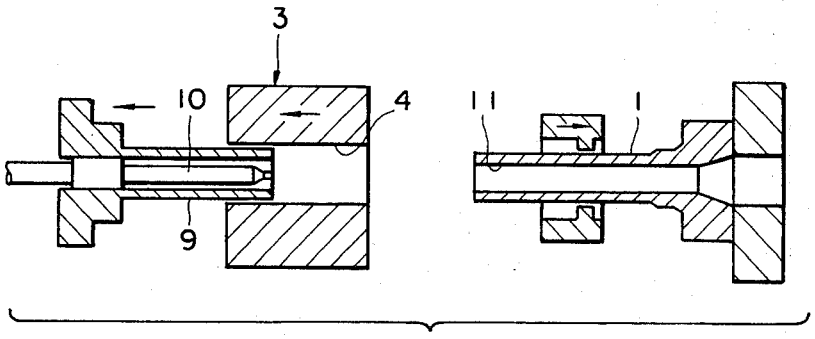
FIGURE. 1(h) PRIOR ART
Figure 2:
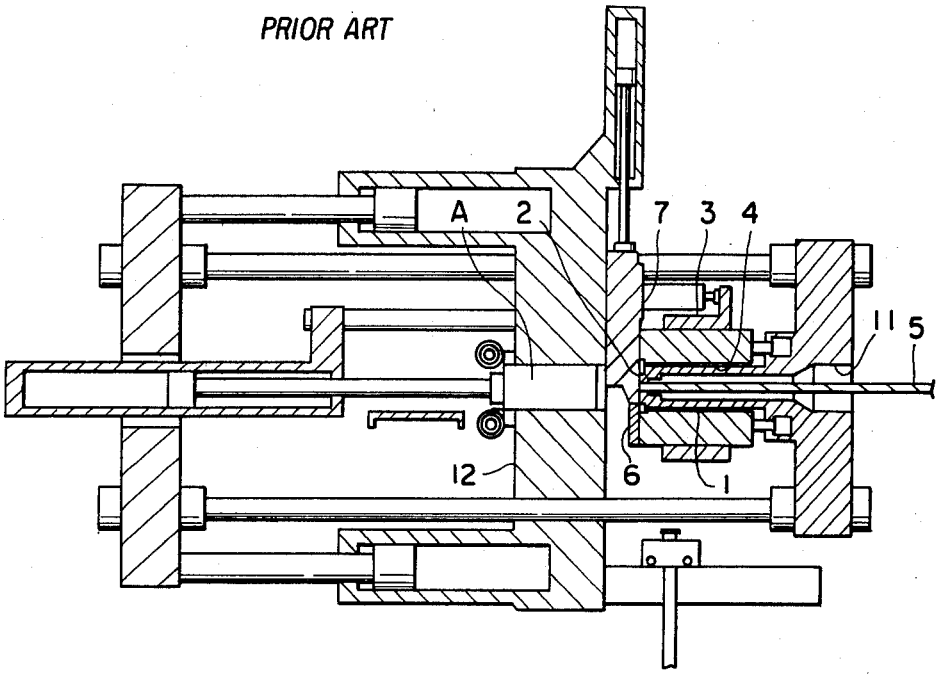
FIGURE. 2 PRIOR ART
FIGS. 2 and 3 are horizontal sections showing another conventional indirect extrusion press.
Figure 3:
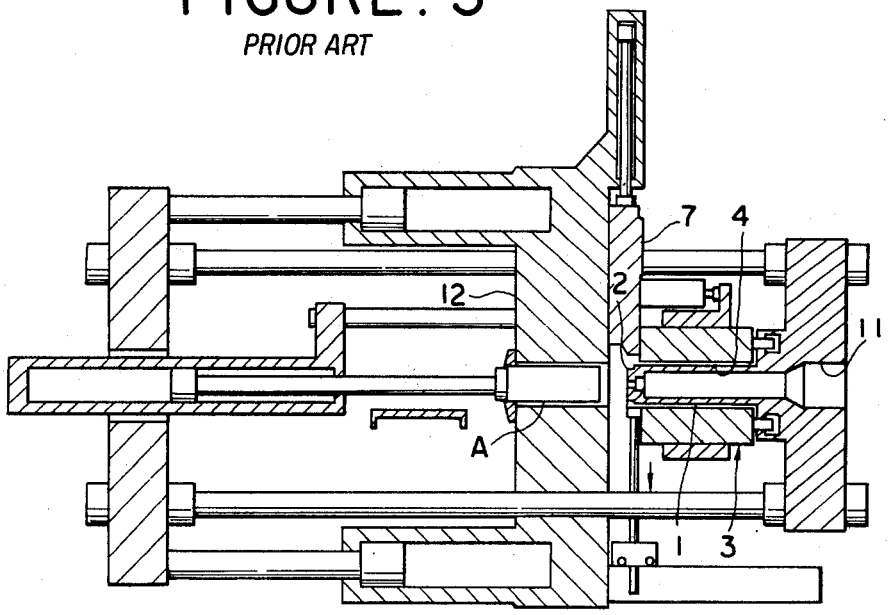
FIGURE. 3 PRIOR ART

In the following description, the directional expressions such as "rear" or "rearward" and "fore" or "forward" are based on the direction in which a billet is extruded.

Referring to FIGS. 4 to 9, there are shown primary components of an indirect extrusion press according to the present invention in various phases of the extruding operation by the press, which includes in the usual manner a container 23, a cylindrical die stem 28, a closure block 24, a shear mechanism 43 and a chuck mechanism 33. As particularly illustrated in FIG. 10, the die stem 28 is provided with a reduced diameter portion **28*a* at its rear end, forming a stepped portion 28*b* for restricting axial sliding movement of a ring 32 which is loosely fitted on the reduced diameter portion 28*a* for cleaning the inner surfaces of the container 23. A loose die 30 which is provided with a die bearing portion 30*a* is detachably mounted on the end face of the reduced diameter portion 28*a* with the bearing portion 30*a* in alignment with the press center thereby, forming a die assembly including the die stem 28, container cleaning ring 32 and loose die 30. The ring 32 and die 30** are opposed in axially spaced positions.

Figure 4:
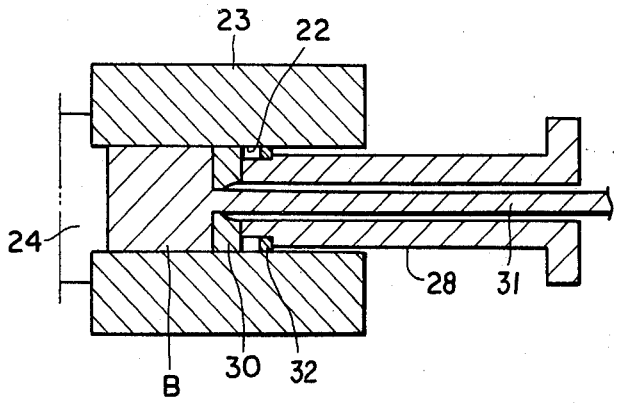
FIGS. 4 to 9 are schematic sectional views showing primary components of an indirect extrusion press incorporating the present invention, in successive phases of the extruding operation by the press.
Figure 5:
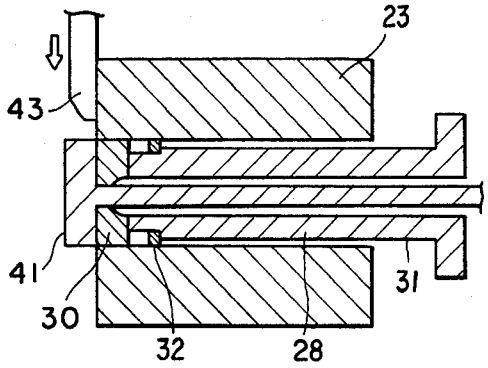

To outline one cycle of the extruding operation, after charging a billet B into the container 23, one open end of the container 23 is closed with the closure block 24 which is movable in a direction perpendicular to the axis of the press, and a pressing force is applied to press the die stem 28 with the loose die 30 and cleaning ring 32 into the container 23 as shown in FIG. 4, extruding indirectly through the die stem 28 an extrudate 31 of the shape which is defined by the die bearing **30*a*, to the right as seen in FIG. 4. During this extruding operation, the circumferential edges of the cleaning ring 32 which is in a position axially spaced from the loose die 30 are slidingly contacted with the inner surfaces 22 of the container 23, so that the shells 47 deposited on the inner container surfaces 22 are scraped off into the form of spiral rings as shown in FIG. 12** and received in the gap S.

Upon completion of extrusion, in order to cut off a discard 41 at the tail end of the extrudate 31, the container 23 is displaced to the right in FIG. 4 by means of a piston-cylinder mechanism (not shown) to bring the end face of the container 23 flush with the end face of the die 30. Then, a shearer 43 which is movable perpendicularly toward and away from the press center is driven to cut off the discard 41 from the extrudate 31.

Figure 6:
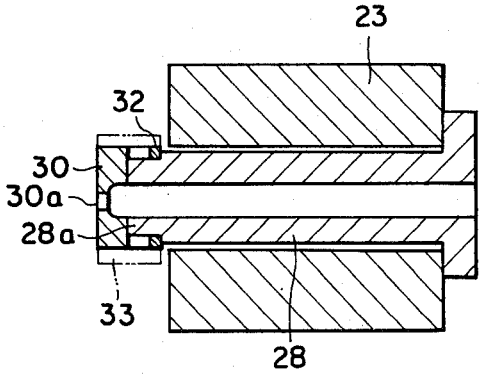
Figure 7:
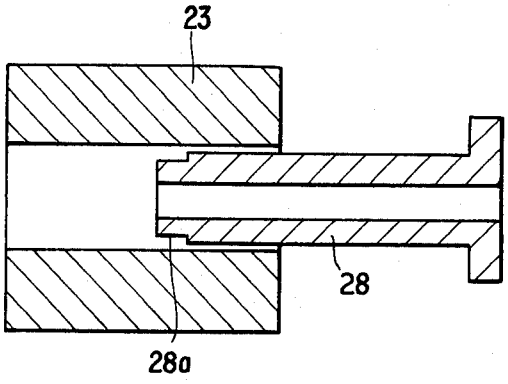
Figure 11:
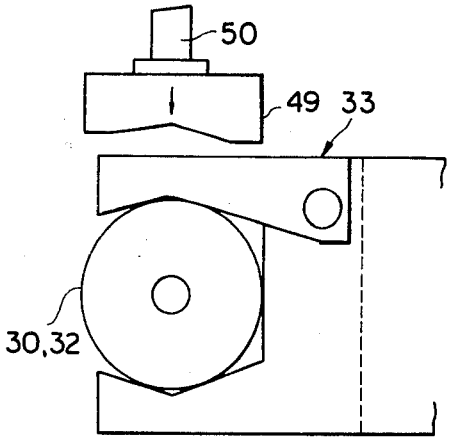
FIG. 11 is a schematic illustration of a chuck mechanism and a knocking member.
Figure 12:
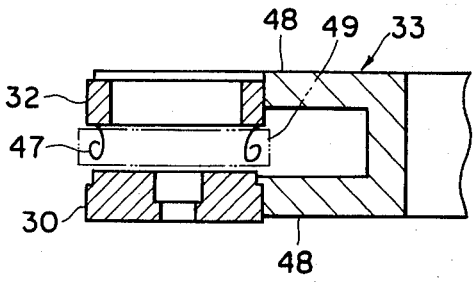
FIG. 12 is a plan view of the components shown in FIG. 11.

In the next phase of operation, the chuck mechanism 33 which is shown particularly in FIGS. 11 and 12 is advanced toward the press center and at the same time the container 23 is moved back further onto the die stem 28 to expose the loose die 30 and cleaning ring 32 out of the container 23 as shown in FIG. 6, whereupon, the die 30 and ring 32 are chucked in a bifurcated end of the handling member 48, which consists of a stationary arm 48*a* and a movable arm 48*b* which is rotatable about a pin toward and away from the stationary arm 48*a* by means of a piston-cylinder mechanism (not shown). Thereafter, the die stem 28 is retracted as shown in FIG. 7 to remove the die 30 and ring 32 respectively from the fore end face and the reduced diameter portion 28*a* of the die stem 28 as shown in FIG. 6, leaving the die 30 and ring 32 in chucked state with a gap space S therebetween. A chip ejector block 49 is then extended into the gap S by operation of a piston-cylinder 50 to get rid of the shells 47.

Figure 13:
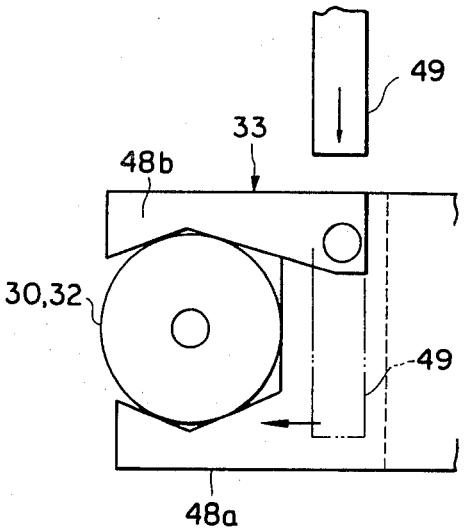
FIG. 13 is a view similar to FIG. 11 but showing a modified knocking member.
Figure 14:
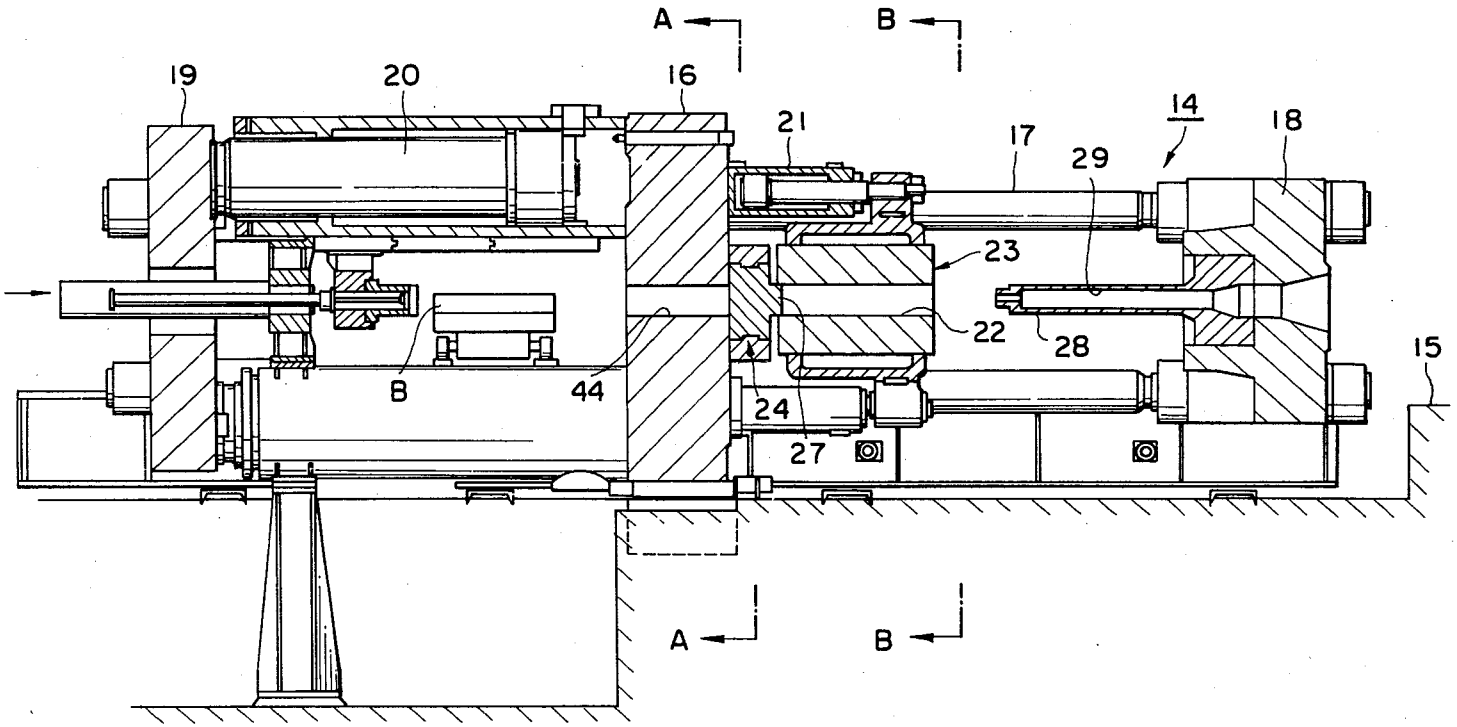
FIG. 14 is a schematic illustration showing the general construction of an indirect extrusion press incorporating the present invention.

In the modification shown in FIG. 13, a knocking block 49 protrudes axially into the space between the gripping arms 48 and is then passed through the space between the die assembly 30 and cleaning die 32 to sweep off the container shells 47 therefrom.

As the loose die 30 and ring 32 are separately positioned with a gap S therebetween, it is possible to remove the shells 47 by the chip ejector block 49 promptly and accurately in an extremely facilitated manner. In addition, the use of the loose die 30 permits removal of the shells from the die bearing portion 30*a* at a spot outside the press machine during transfer of the bearing portion, if desired.

After once removing the loose die 30 and cleaning ring 32 from the press center in this manner by the operation of the handling member 48, the loose die 30 with the bearing portion 30*a*, which, if necessary, has been cleaned to get rid of the shells as mentioned above, and the cleaning ring 32 are returned to the working positions at the press center in front of the open end of the container 23. Thus, the chucking portion of the handling member 48 is alternately moved toward and away from the press center by a rocking or lifting mechanism, and the entire body of the handling member 48 itself which is located outside the press machine is movable back and forth in the pressing direction.

Figure 8:
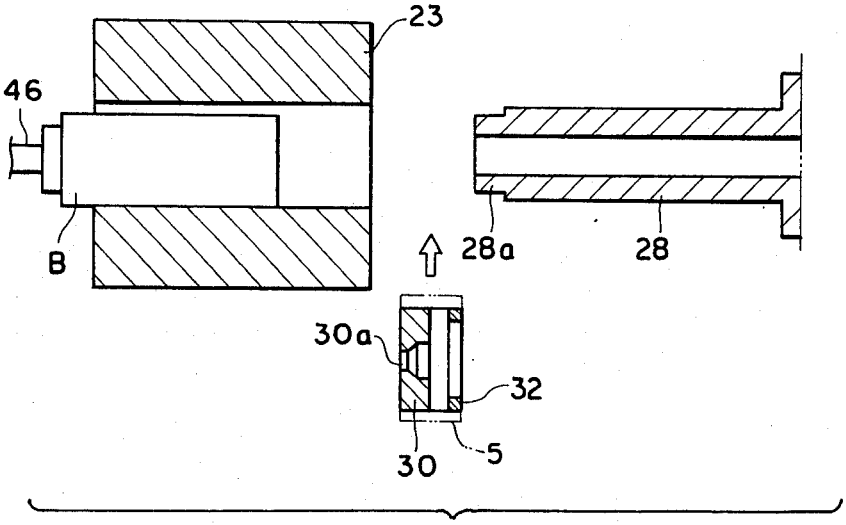
Figure 9:
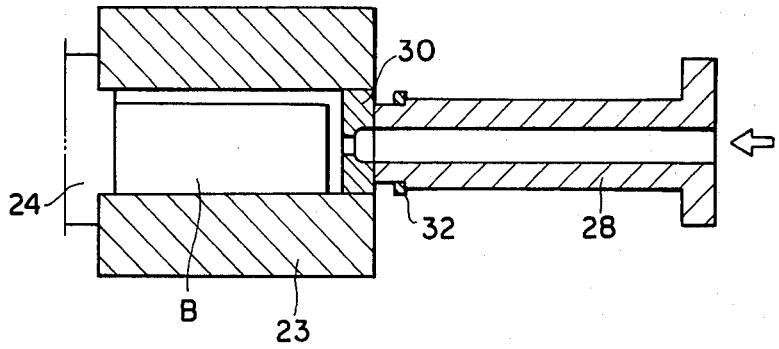
Figure 10:
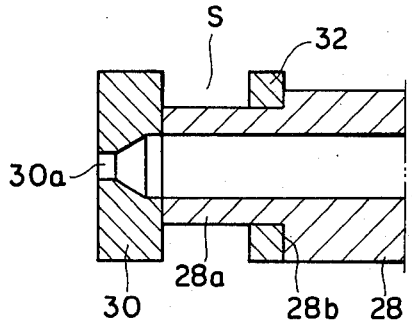
FIG. 10 is an enlarged sectional view of the die assembly according to the invention.

On the other hand, the container 23 which has its inner surfaces already cleaned simultaneously with the extruding operation is charged with a fresh billet through a billet pusher 46, and the die stem 28 is moved to the right in FIG. 8, skewering through the cleaning ring 7 which has been returned to the press center together with the loose die 30 as mentioned hereinbefore, thereby mounting the cleaning ring 32 and loose die 30 respectively on the reduced diameter portion 28*a* and rear end face of the die stem 28. Thereafter, the open end of the container 23 is closed again by the closure block 24 as shown in FIG. 9.

The indirect extrusion apparatus basically consists of a die assembly including a container 23, loose die 30 and die stem 28 and a handling mechanism 48 for moving the loose die between the press center and a position outside the press machine, in which a cleaning ring 32 is slidably and detachably fitted on a reduced diameter portion 28*a* at the fore end of the die stem 28 for cleaning the inner surfaces 22 of the container 23, and a loose die 30 which defines the shape of the material to be extruded is detachably mounted on the end face of the reduced diameter portion 28*a* of the die stem 28.

The indirect extrusion press of the foregoing embodiment has a number of advantages. For example, since the loose die 30 and cleaning ring 32 are provided separately on the die stem 28, it becomes easier to fabricate the loose die 30 and cleaning ring 32 and to maintain a constant accuracy even in the extrusion of a product with a severe tolerance by the repeated use of a single die 30, in addition to the fundamental advantage in that the cleaning of the container 23 can be effected simultaneously with the extrusion of a billet.

Further, the container cleaning ring 32 which is detachably fitted on the reduced diameter portion 28*a* at the fore end of the die stem 28 is detached from the die stem 28 and retracted into a position outside the press machine together with the loose die 30 after the extruding and shearing phases of the operation, maintaining a space from the loose die 30, so that the spirally curled shells 47 around the ring 32 can be removed easily and promptly, simply by protruding the shell ejecting block 49 into the gap S between the loose die 30 and cleaning ring 32.

Referring now to FIGS. 14 to 17, there is shown a pull-back type indirect extrusion press 14 according to the present invention, including an intermediate platen 16 which is fixed on a machine bed 15, a press platen 18 and a rear platen 19 which are located respectively on the front and rear sides of the intermediate platen 16 and connected with each other by a number of parallel tie rods 17, and a main piston-cylinder 20 which is located between the intermediate and rear platens 16 and 19. Mounted on the front side of the intermediate platen 16 which faces the press platen 18 is a container 23 which is movable back and forth through operation of a container transfer cylinder 21 and which is provided with an axial billet-receptacle bore 22, and a movable closure block 24 which is movable in a radial direction or perpendicularly to the pressing direction between the intermediate platen 16 and container 23 in sliding contact with the former. The movable block 24 is formed successively in the radial direction with a discard receptacle hole 25, a billet feeding hole 26 and a blind lid 27 for disengageably closing the rear open end of the billet receptacle bore 22. A die stem 28 which is projectingly mounted on the rear side of the press platen 18 is provided with an axial hole 29 in alignment with the billet receptacle bore 22 at the press center.

A die assembly 30 which consists of a die and a die holder is detachably mounted on the rear free end of the die stem 28, the die assembly 30 being axially movable in and relative to the billet receptacle bore 22 to impart a predetermined shape to an extrudate 31. In the particular example shown, the press platen 18 is moved rearward by extension of the main cylinders 20, pressing and deforming the billet B to form an extrudate 31 by the die assembly 30 which is also moved rearward within the billet receptacle hole 22. In this instance, backward movement of the billet B is blocked by the blind lid portion 27 of the movable block 24.

Similarly to the foregoing embodiment, a container cleaning ring 32 which is detachably fitted on the reduced rear end portion 28*a* of the die stem 28 is located in an axially spaced position forward of the die assembly 30 which is mounted on the rear end face of the die stem 28, so that it is also moved through the billet receptacle bore 22 after the die assembly 30 in sliding contact with the inner periphery of the billet receptacle bore 22. The shells of the billet B which deposit on the inner periphery of the billet receptacle bore 22 are scraped off by this displacement of the container cleaning ring 32 within the billet receptacle bore 22.

A chuck mechanism 33 which releasably chucks simultaneously the die assembly 30 and container cleaning ring 32 is movable in a direction perpendicular to the axis of the press and mounted on a transfer mechanism 34 for movement in the axial direction of the press. The transfer mechanism 34 includes a rack gear 35 having its axis disposed perpendicular to the axis of the press and carrying the chuck mechanism 33 on the side of the press; a carrier body 37 supporting thereon the rack gear 35 and having a rotatingly drivable pinion 36 meshed with the rack gear 35 for moving same in the axial direction thereof; a holder 38 accommodating and holding the chuck mechanism 33 when in retracted rest position outside the press machine; and a piston-cylinder 40 for moving the carrier body 37 on and along a rail 39. By cooperation of the chuck and transfer mechanisms 33 and 34, the die assembly 30 and container cleaning ring 32 are moved into and out of the machine for mounting and dismantling at positions at the front and rear ends of the billet receptacle bore 22, respectively. The chuck mechanism 33 is slidable on and along a guide member 33*a* (see FIGS. 18, 20).

The shell or discard receptacle bore 25 which is located on the outer side of the rear end of the billet receptacle bore 22 is formed in a circular shape to loosely or tightly receive therein a discard billet stub 41 which remains at the fore end of the die assembly 30 when seen in the direction of its axial movement relative to the billet receptacle bore 22 or at the rear end of the die assembly 30 when seen in the extruding direction. The discard receptacle hole 25 and the die assembly 30 which is held in the chuck mechanism 33 are relatively movable in a direction perpendicular to the axis of the press to cut off the discard 41 from the tail end of the extrudate 31. In the particular embodiment shown, the discard 41 is cut off by a transverse movement of the movable block 24. At this time, the shearing force is born by the chuck mechanism 33 which is locked to the intermediate platen 16 through a locking mechanism consisting of piston-cylinder 42 or other suitable means. Thus, the movable block 24 with the discard receptacle bore 25 constitutes a main part of discard shearing mechanism 43.

A billet loader 45 which is provided between the intermediate and rear platens 16 and 19 for feeding a billet B to the machine. A billet B which is brought in by the billet loader 45 is pushed into the billet receptacle bore 22 of the container 23 through a billet feeding hole 44 in the intermediate platen 16 and through the aforementioned billet feeding hole 26 in the movable block 24, respectively by a billet pusher 46 which is connected to the intermediate platen 16 through tie rods 46*a*.

FIGS. 15 to 26 illustrate various stages in one cycle of operation by the press machine of the present embodiment.

Figure 15:
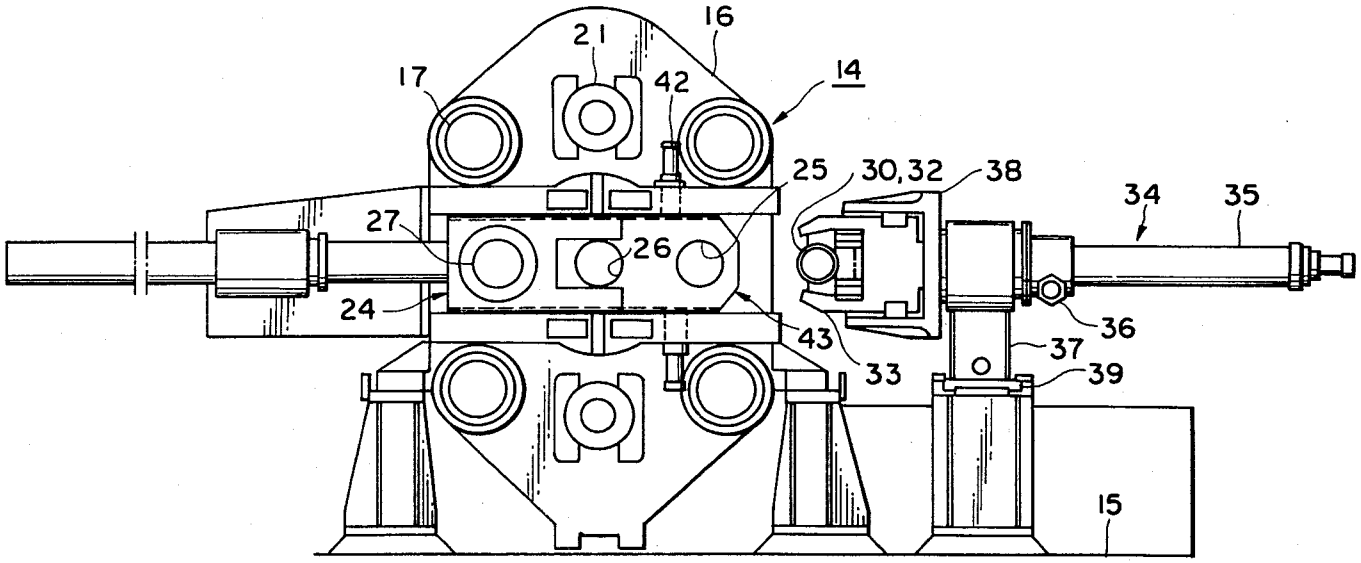
Figure 16:
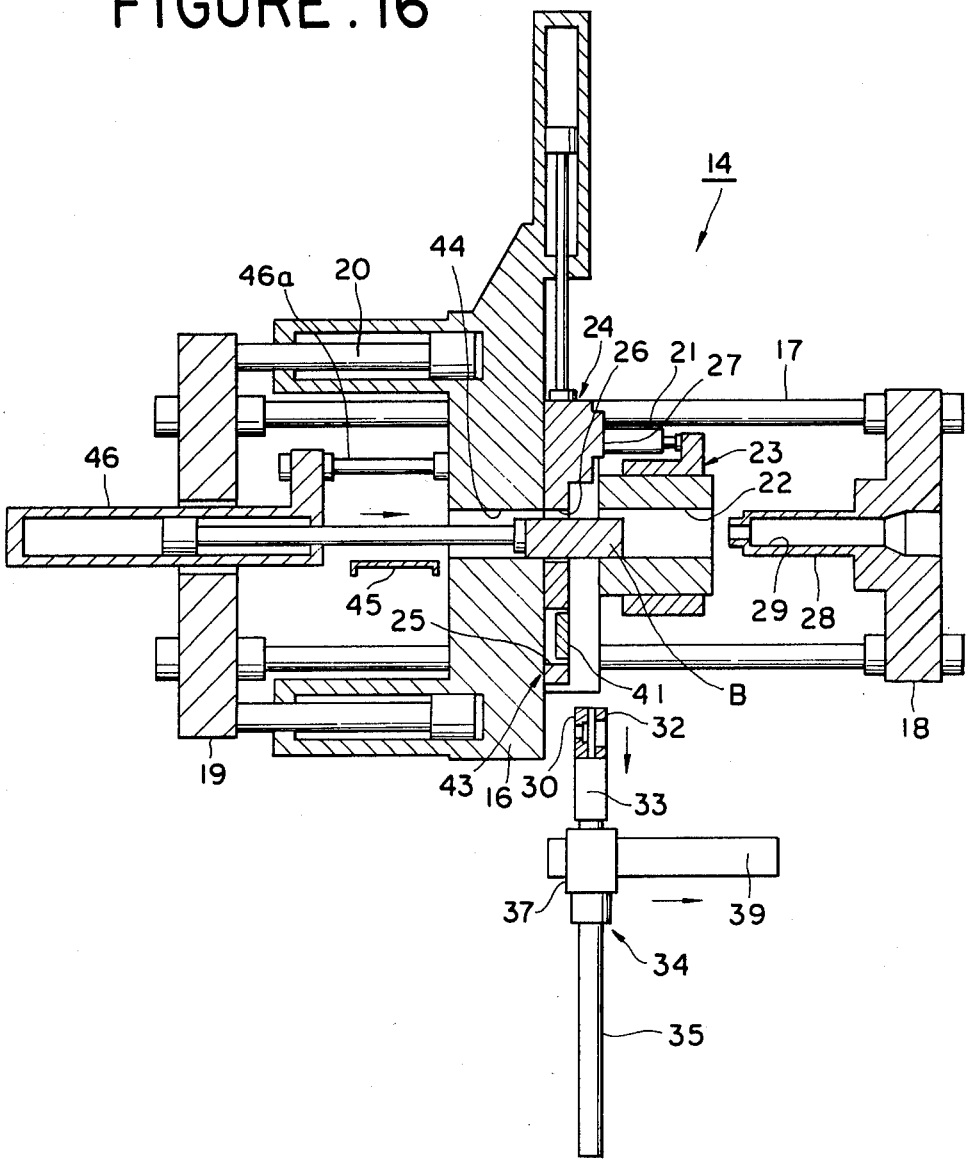
Figure 17:
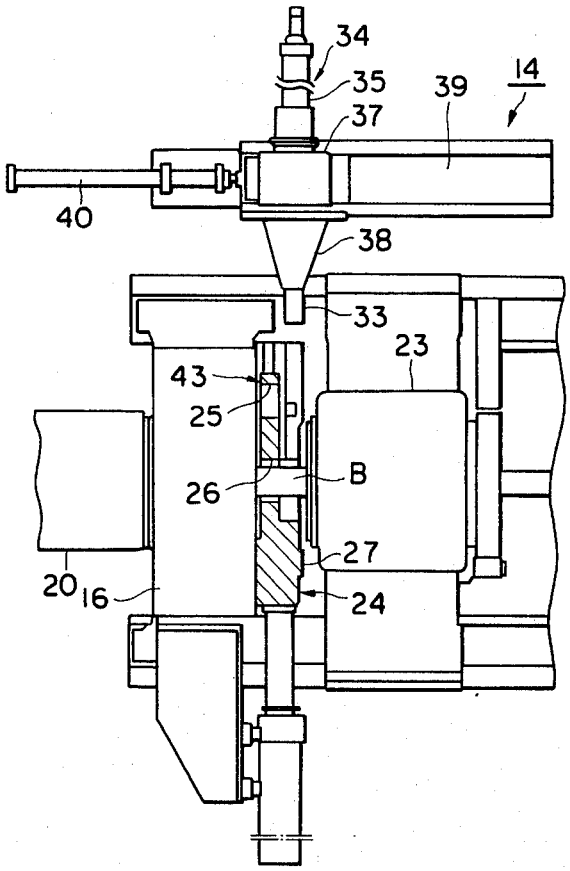

In the first stage shown in FIGS. 15 to 17, the movable block 24 is displaced to position its billet feeding passage 26 at the press center and then a billet on the billet loader 45 is pushed forward by the billet pusher 46 until it is completely charged into the billet receptacle bore 22 of the container 23 successively through the billet feeding holes 44 and 26 in the intermediate platen 16 and movable block 24. At this time, the die assembly 30 and container cleaning ring 32 are held in coaxially spaced positions by the chuck mechanism 33 outside the press machine.

Figure 18:
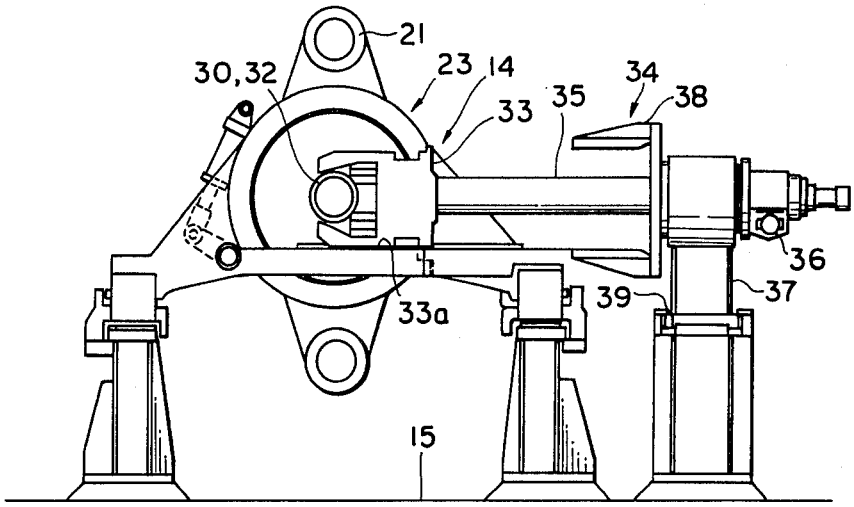
Figure 19:
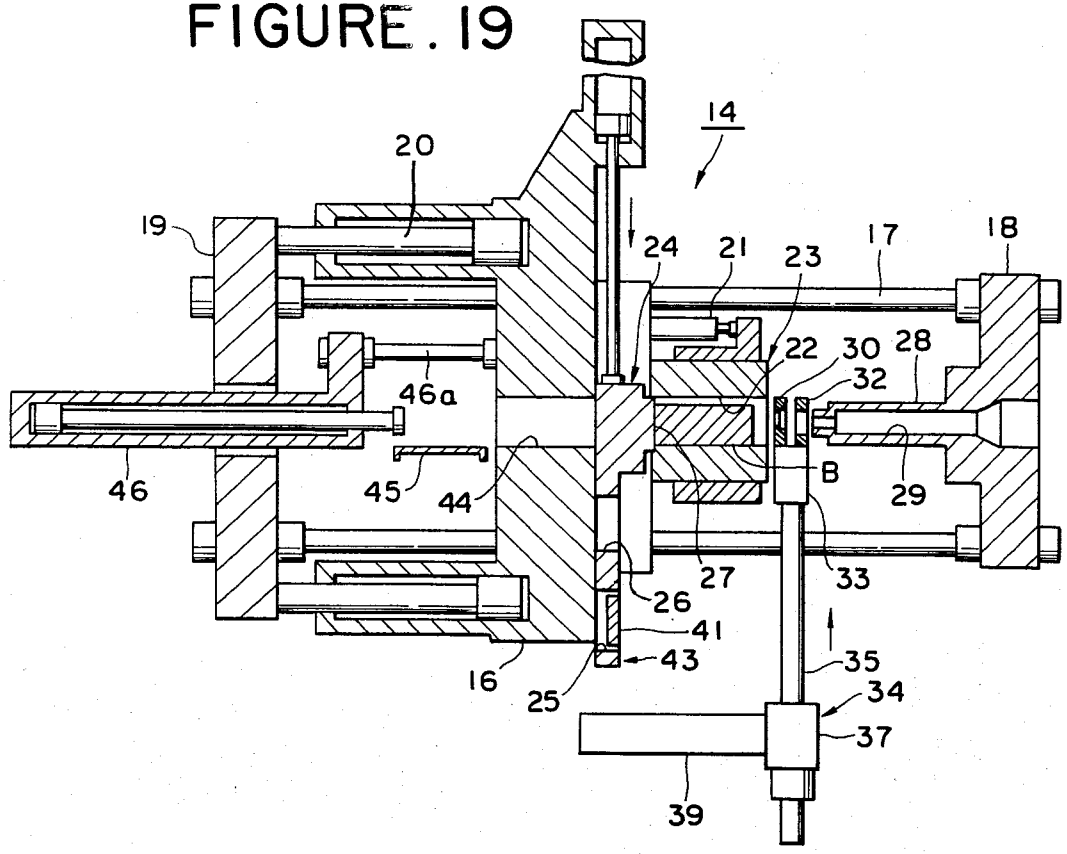

In the second stage shown in FIGS. 18 and 19, the movable block 24 is displaced relative to the container 23 to close the rear opening of the billet receptacle bore 22 with the blind lid 27 to thereby limit the rearward movement of the billet B. The die assembly 30 and container cleaning ring 32 which are held in the chuck mechanism 33 are then positioned at the press center between the container 23 and die stem 28 by the operation of the transfer mechanism 34.

Figure 20:
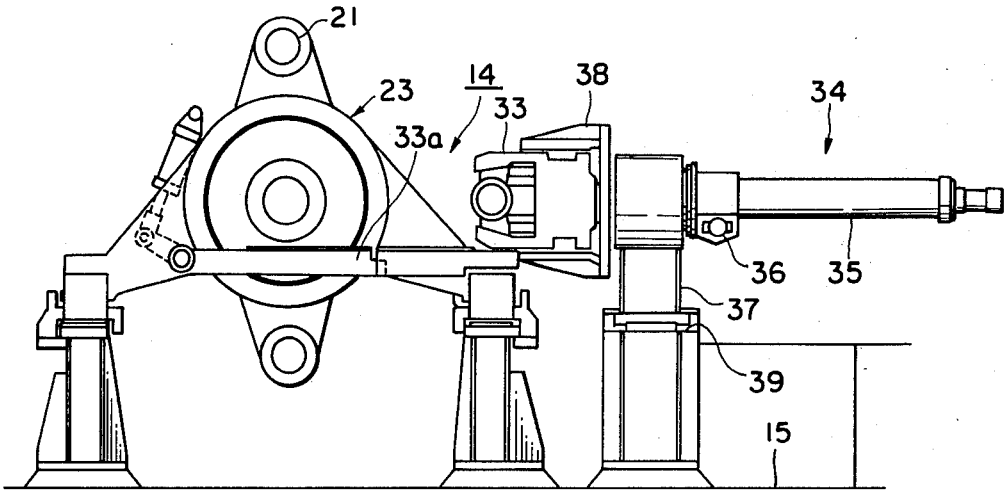
Figure 21:
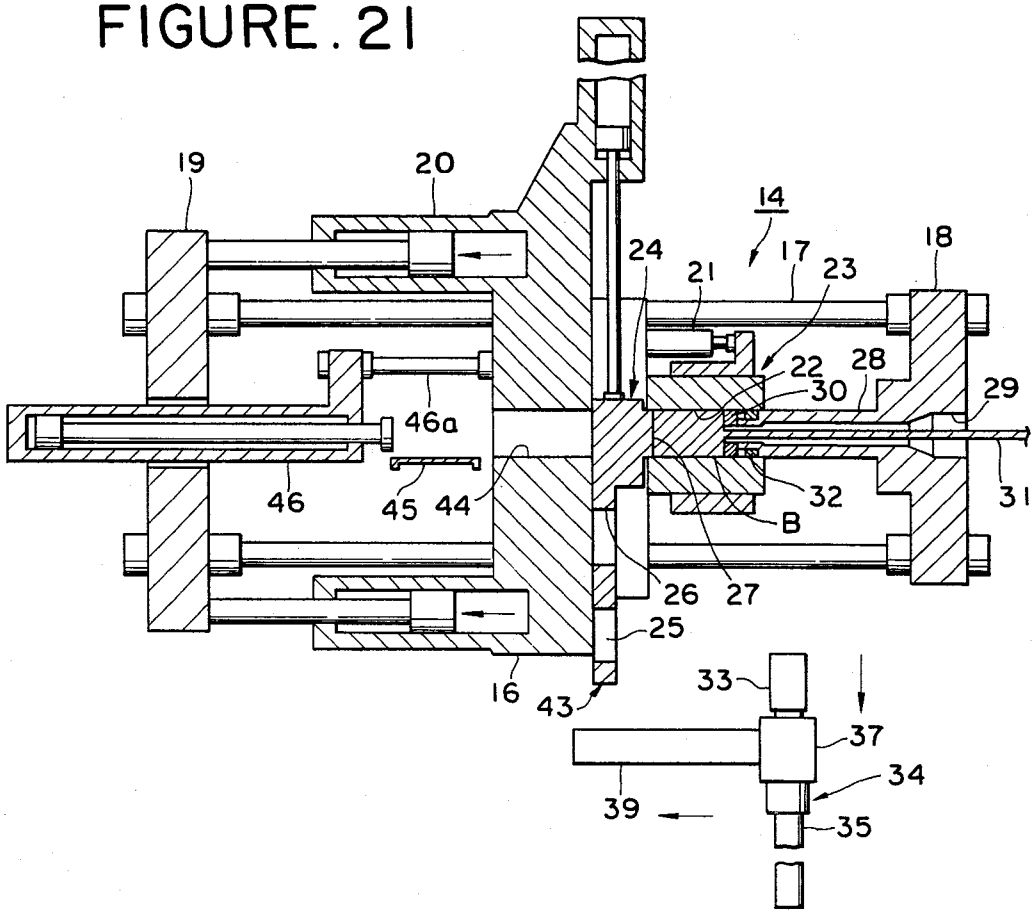

In the third stage shown in FIGS. 20 and 21, the rear platen 19 is moved backward by extension of the main cylinders 20, pulling back the press platen 18 and pushing into the billet receptacle bore 22 the die assembly 30 and container cleaning ring 32, which have been released from the chuck mechanism 33, with the rear end of the die stem 28 to extrude the billet B through the die hole. The extruded material 31 is taken out of the machine through the axial passage 29 in the die stem 28. In this instance, there is no relative movement between the container 23 and billet B.

Figure 22:
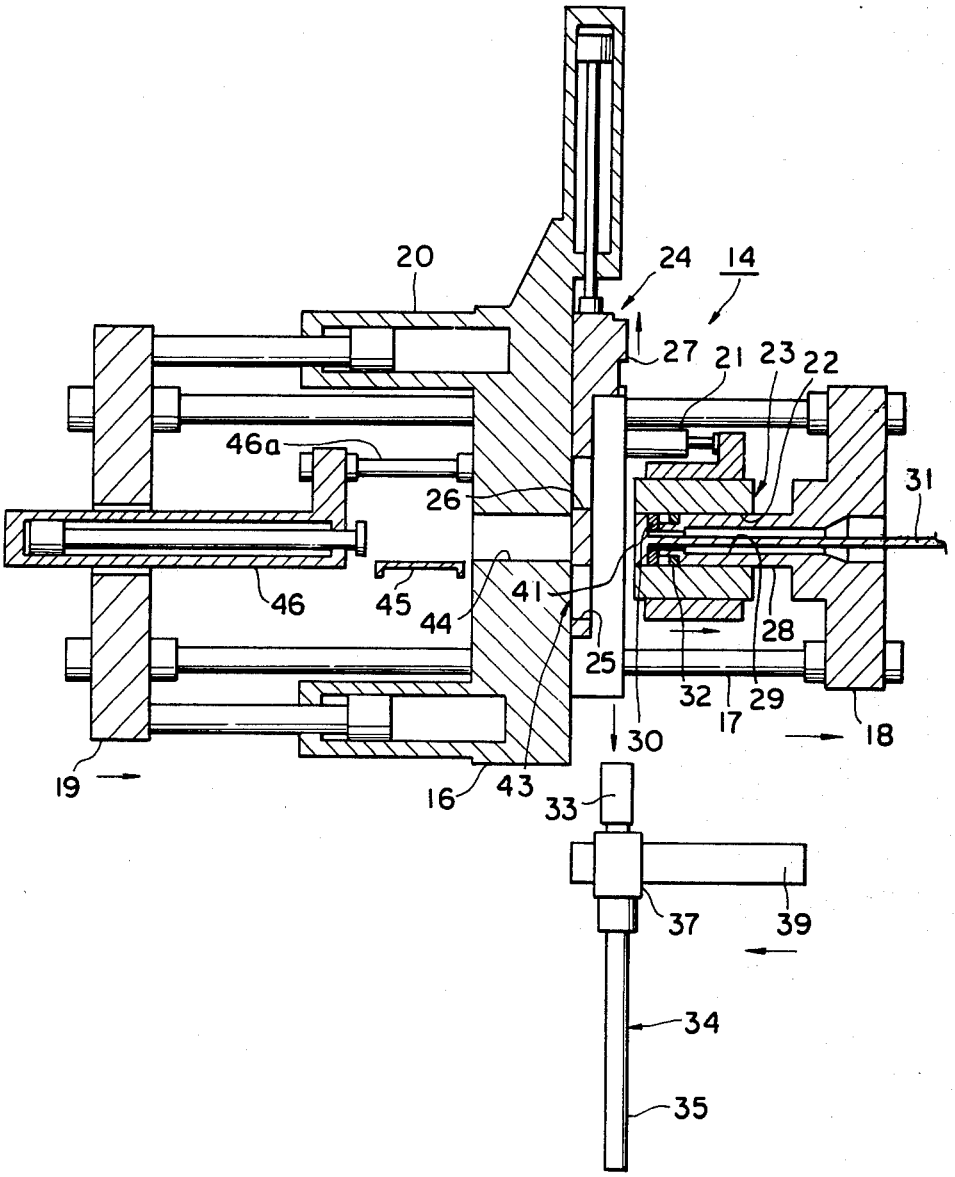
FIG. 22 is a sectioned bottom view of the press of FIG. 14, showing the operation in the fourth stage of the press cycle.

FIG. 22 shows the fourth stage of operation which is concurrent with the pressing operation in the third stage and in which the chuck mechanism 33 is retracted into a position outside the press machine and transferred rearward to return to its initial position assumed in the first stage.

Figure 23:
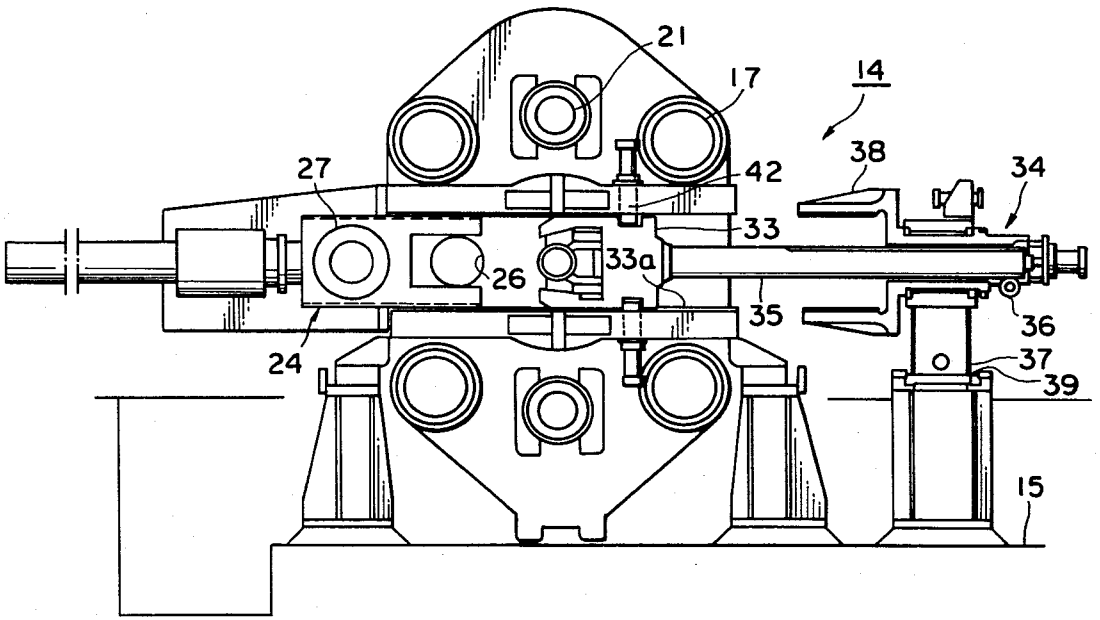
Figure 24:
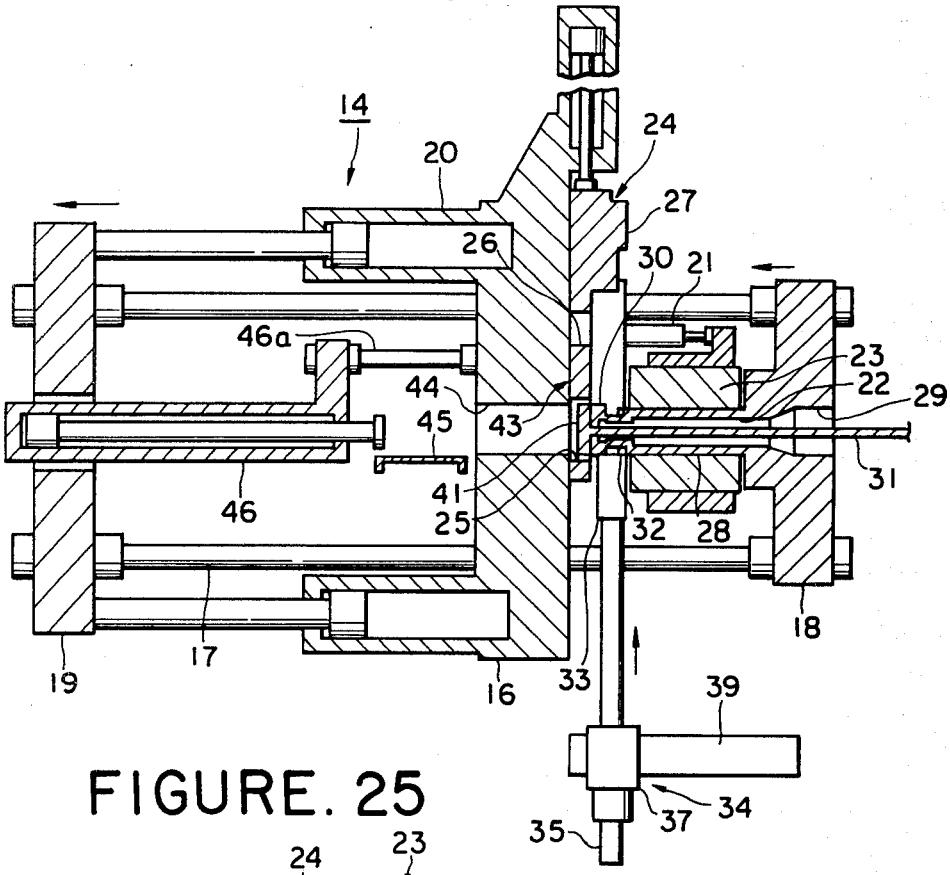
Figure 25:
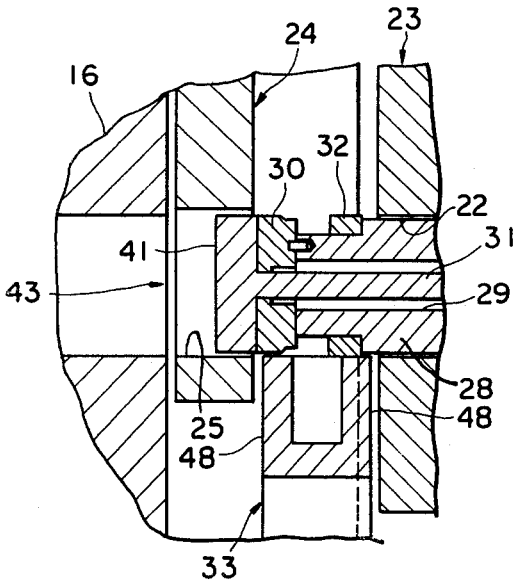

In the fifth stage shown in FIGS. 23 to 25, the discard receptacle hole 25 is positioned at the press center by movement of the movable block 24. On the other hand, by movement of the container 23 relative to the die stem 28, the discard billet 41 in the container 23 is pushed into the discard receptacle bore 25 by the relative axial movement of the container 23 and die stem 28, while the die assembly 30 and cleaning ring 32 which are pushed out of the container 23 are gripped in the advanced chuck mechanism 33. The chuck mechanism 33 is then locked to the intermediate platen 16 by the locking mechanism 42.

Figure 26:
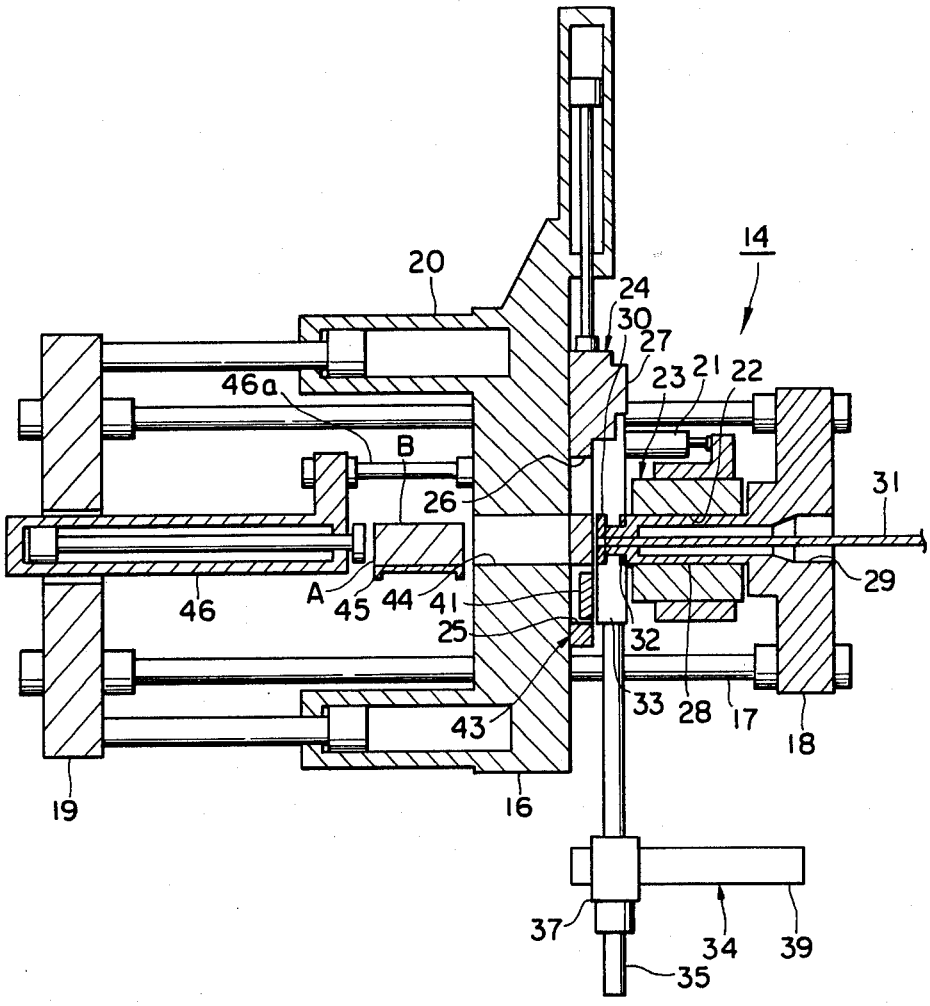
FIG. 26 is a sectioned bottom view of the press of FIG. 14, showing the operation in the sixth stage of the press cycle.

FIG. 26 illustrates the sixth stage of operation, in which the discard billet 41 is sheared from the extrudate 31 by a transverse movement of the movable block 24 from the position shown in the fifth stage. Thereafter, the extrudate 31 is drawn out of the machine, and the die assembly 30 and cleaning ring 32 in the chuck mechanism 33 are dismantled from the die stem 28 and transferred to a position outside the press machine. The sixth stage is followed by the above-described first stage to start a new cycle of operation.

Figure 27:
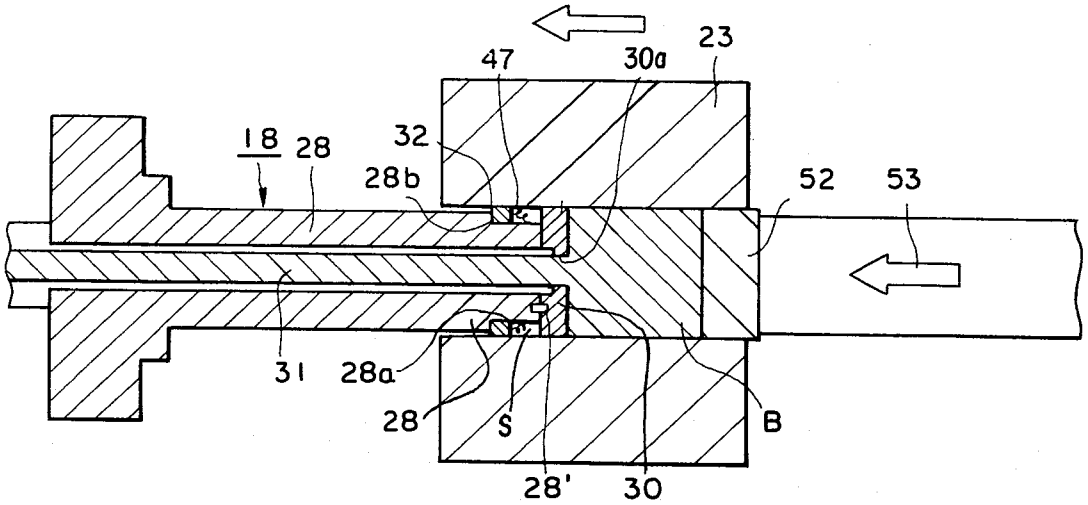
FIG. 27 is a sectioned side view of primary components in another indirect extrusion press incorporating the present invention in an extruding phase.
Figure 29:
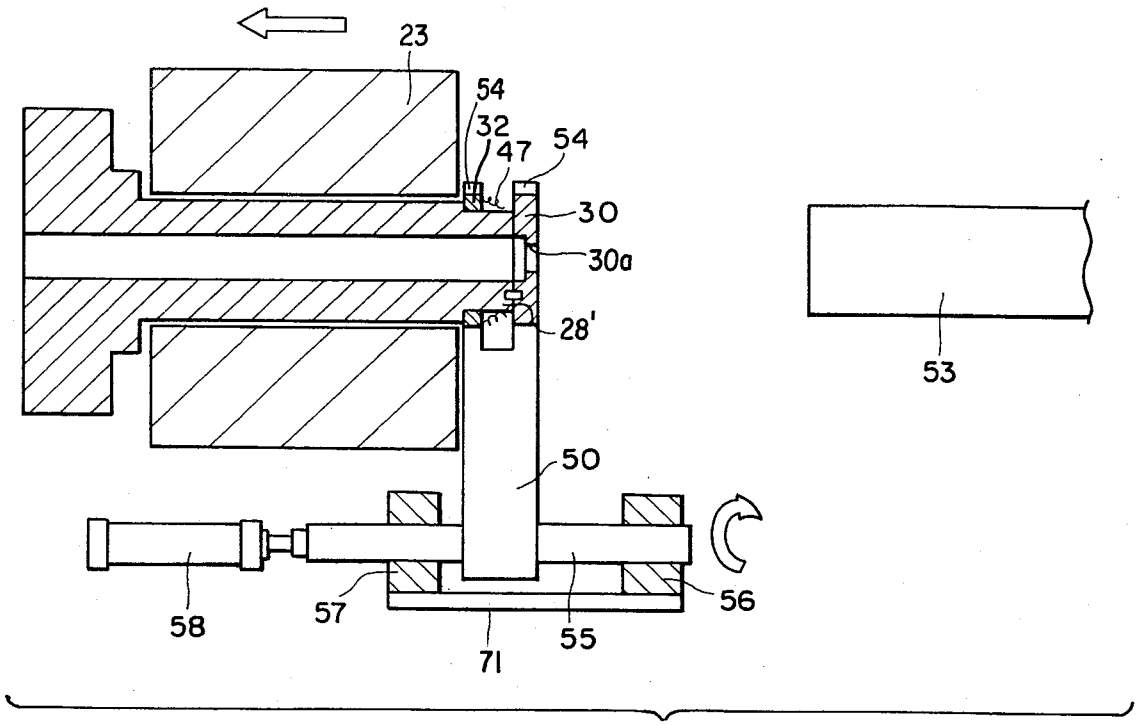
FIG. 29 is a sectioned side view of a die handling mechanism in actuated stage.
Figure 30:
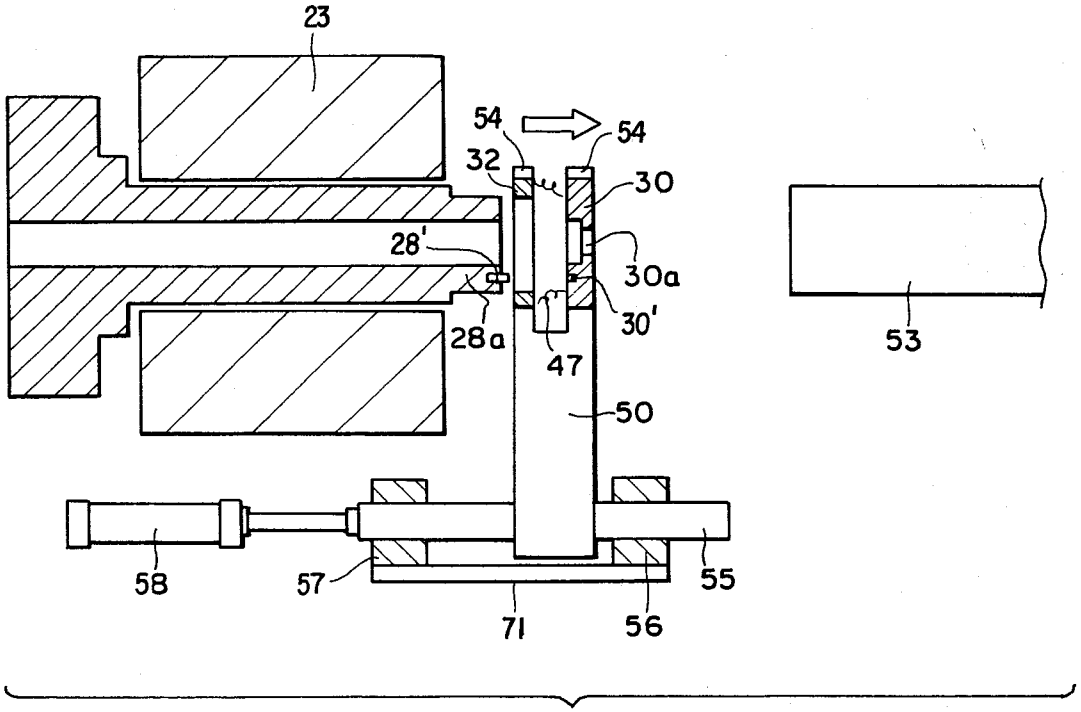
FIG. 30 is a sectioned side view of the same die handling mechanism in a die dismantling stage.
Figure 31:
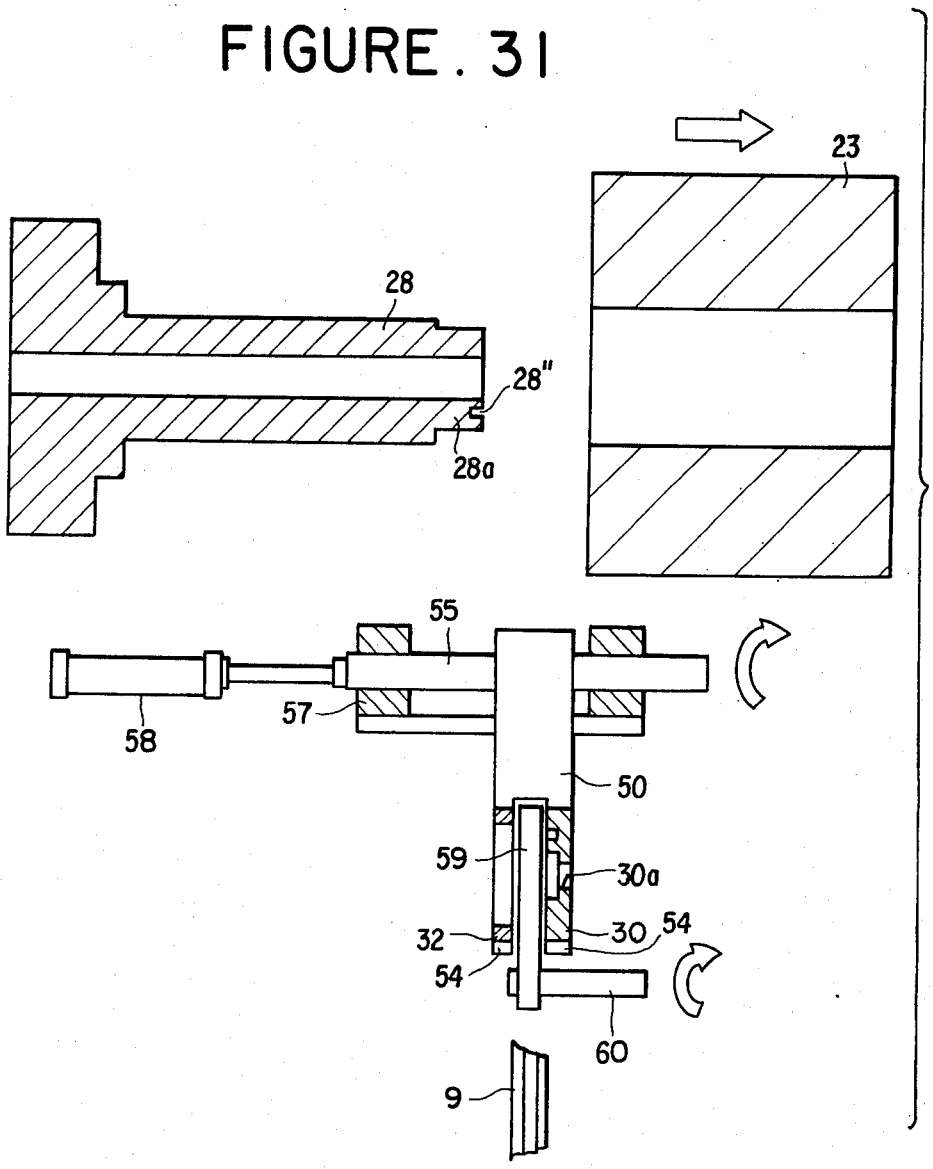
FIG. 31 is a sectioned side view of the die handling mechanism in a shell removing stage.
Figure 32:
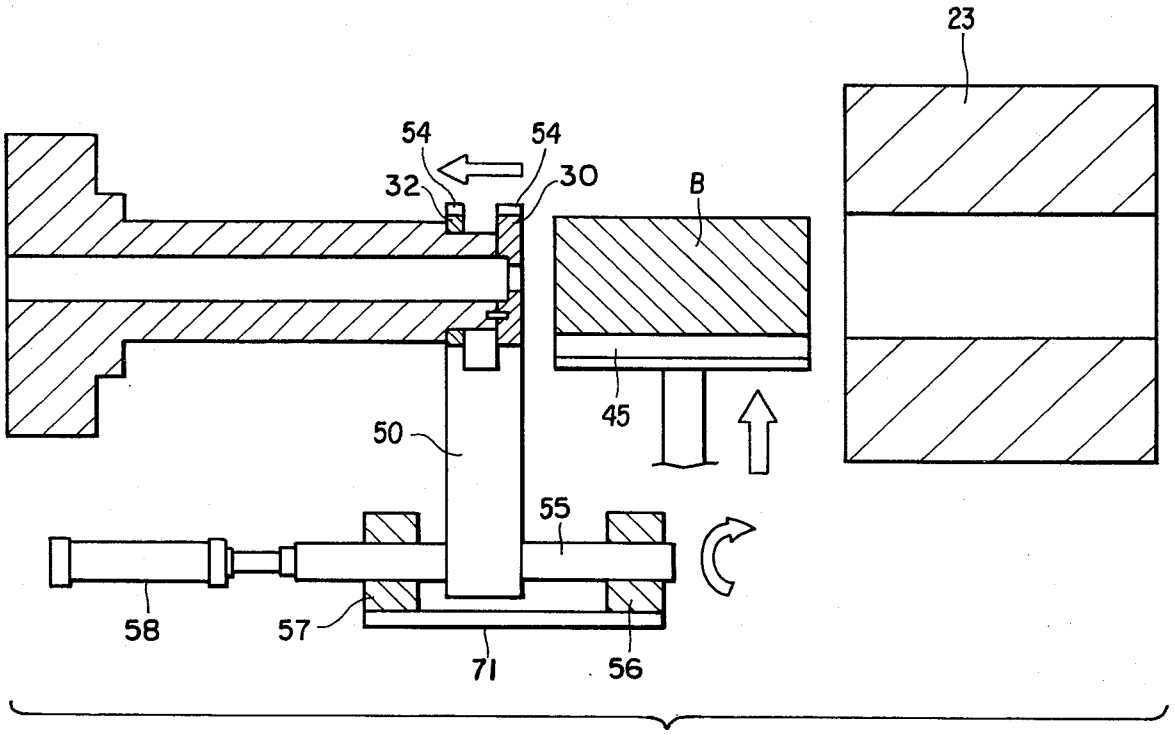
FIG. 32 is a sectioned side view of the die handling mechanism in a die remounting stage.

Referring to FIG. 27 and onwards, there is shown a still another embodiment of the invention employing a die handling mechanism of a different construction at one side of the rear end of the die stem 28 as shown in FIGS. 29 to 31 for handling a loose die 30 and a cleaning ring 32 which are detachably mounted on the die stem 28 in the same manner as in the foregoing embodiments. As particularly shown in FIGS. 29 and 30, the handling mechanism 50 is movable back and forth in the axial direction of the press and between a pair of brackets 56 and 57 which are provided on a base frame 71 outside the press machine, and supported on a reciprocable rotary shaft 55 which is movable back and forth in the axial direction and at the same time rotatable about its axis. Therefore, the handling mechanism 50 is linearly movable along the reciprocable shaft 55 in the axial direction of the press and swingable about the axis of the shaft 55 between an inner position where clamp members 54 which are provided at the fore end of the handling mechanism 50 are disposed coaxially with the loose die 30 and cleaning ring 32 at the press center as shown in FIGS. 29 and 30, and an outer position where the whole structure of the handling mechanism 50 is positioned outside the press without interfering with movements of the container 23 or other operating parts of the press machine, as shown in FIG. 31. Designated at 58 is a hydraulic cylinder which is shown as an example of the drive means for linearly reciprocating and rotating the shaft 55 and which may be replaced by other suitable means if desired. Further, according to the present invention, the handling mechanism 50 has a knock-out member 59 swingably supported on, for example, a rotatable or rockable shaft 60 in its receded position outside the press machine to thereby remove the container shells 47 which have deposited in the gaps between the loose die 30 and the cleaning ring 32.

Figure 28:
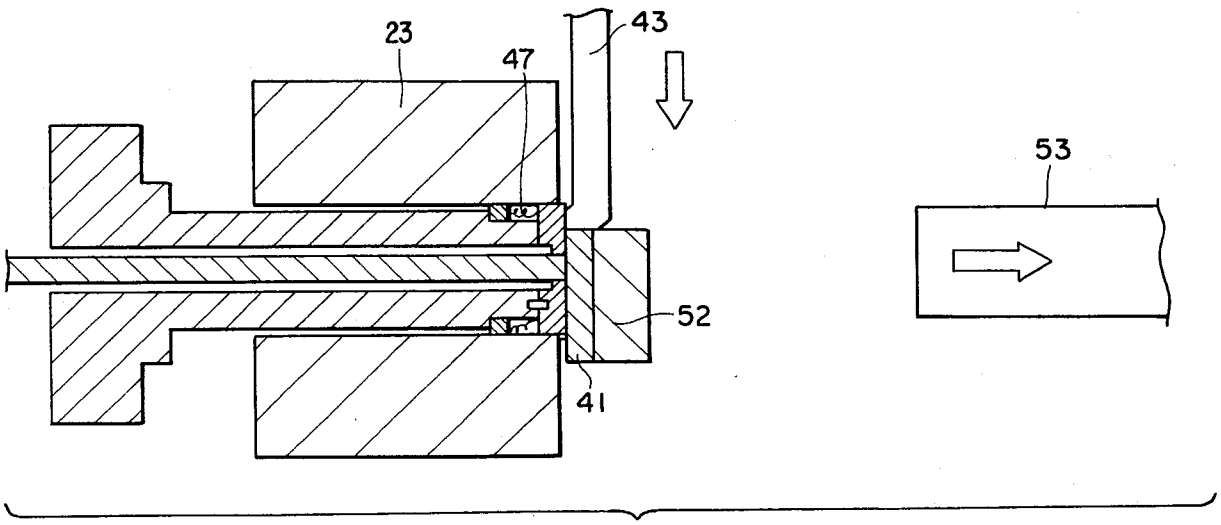
FIG. 28 is a sectioned side view of the same press in a stage immediately after completion of extrusion.

In operation, the container 23 and pressing stem 53 are moved toward the die stem 28 as indicated by arrows to extrude the billet B in the container 23 through the loose die 30 to produce an extrudate 31, which is delivered through the die stem 28. During this extruding operation, the shells 47 on the inner surfaces of the container 23 are scraped off by the cleaning ring 32, collecting the scraped shells 47 in the gaps between the ring 32 and die 30 in the same manner as in the foregoing embodiments. Upon completion of extrusion, the discard billet stub 41 and dummy block 52 are exposed from the rear end of the container 23 as shown in FIG. 28, the right end in that figure, in the known manner and the shearer 43 is advanced as indicated by the arrow to cut off the discard 41, followed by retraction of the pressing stem 53. In the next phase, the container 23 is moved again slightly away from the pressing stem 53 as indicated by an arrow in FIG. 29 to expose at the right end of the container 23 the loose die 30 and cleaning ring 32 which are mounted on the die stem 28, and the handling mechanism 50 is swung in toward the press center by rotation of the swing shaft 55 from its retracted position outside the press machine, positioning the clamps 54 concentrically with the axis of the press to grip the exposed die 30 and cleaning ring 32 securely and firmly therein. At this time, the container shells 47 which have been scraped off from the inner surfaces of the container 23 by the cleaning ring 32 are retained in the gap S between the die 30 and ring 32. Then, the reciprocable shaft 55 is moved linearly in the axial direction toward the pressing stem 53 as shown in FIG. 30 to remove the loose die 30, cleaning ring 32 and container shell 47 from the die stem 28 which is retained in the stationary position as shown in FIG. 30. In this instance, it is necessary to grip the loose die 30 and cleaning ring 32 firmly by the clamps 54 without deviations in relative positions until they are remounted on the die stem 28 after knocking off the shells 47. The handling mechanism 50 is swung out from the position of FIG. 30 to the position shown in FIG. 31 by rotating the swing shaft 55 in the opposite direction, and the knock-out member 59 which is located outside the press machine is actuated to turn or swing into the gap S between the loose die 30 and cleaning ring 32 to remove the shells 47 therefrom or, if necessary, to clean the die 30 and ring 32. In the meantime, the container 23 is moved in the direction indicated by arrow in preparation for the charging of a fresh billet.

Figure 33:
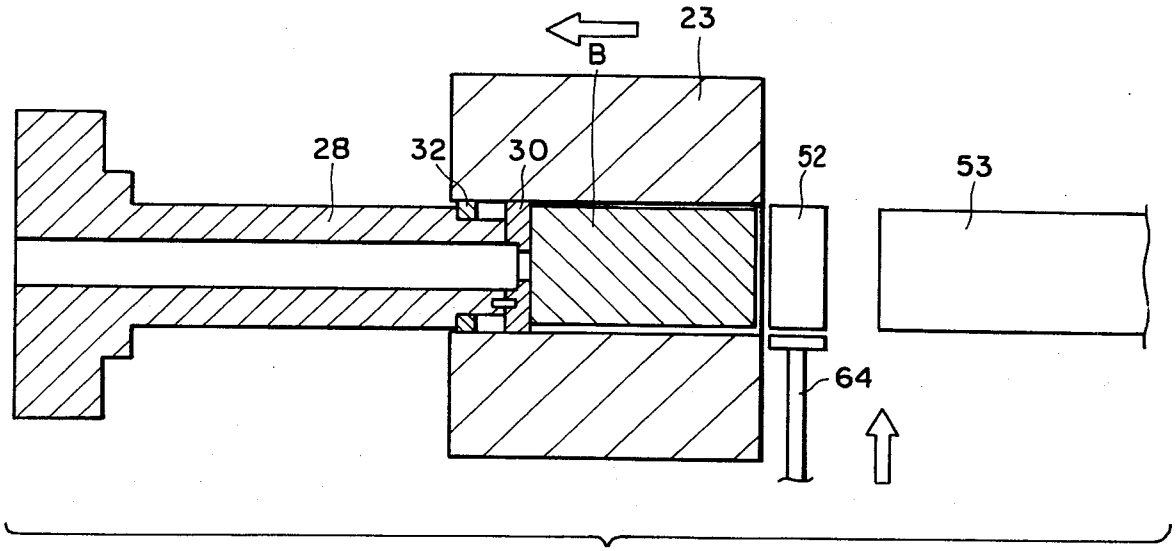
FIG. 33 is a sectioned side view of the die handling mechanism in a stage immediately before billet extrusion.

After the removal of the container shells 47 and necessary cleaning, the reciprocable shaft 55 is rotated about its axis to bring the die 30 and cleaning ring 32 to the inner position from the outer position of FIG. 31, succeeded by a linear movement of the shaft 55 toward the die stem 28 to mount again the die 30 and ring 32 on the reduced diameter portion **28*a* of the die stem 28, while the cleaning ring 32 is abutted against the stepped portion 28*b* of the reduced diameter portion 28*a* and the loose die 30 is mounted in position by engagement of a positioning hole 30' formed therein with the knock pin 28' disposed in a positioning hole 28'' formed in an end face portion of the reduced diameter portion 28*a* of the die stem, a fresh billet B is delivered in front of the container 23 by the billet loader 45. This is followed by release of the clamps 54, a turn of the handling mechanism 50 to its retracted position outside the press machine and charging of the fresh billet by relative movement of the container 23 to establish the state as illustrated in FIG. 33. After positioning a fresh dummy block 52 at the rear end of the billet B by the dummy block loader 64, the pressing stem 53** is actuated to commence a new cycle of the extruding operation for the fresh billet B.

Thus, after extruding a billet B by the use of the die assembly which consists of the die stem 28, loose die 30 and cleaning ring 32, it has become possible to perform smoothly a series of operations which are required before commencement of a next cycle of extruding operation by the use of the same die, including regression of the die 30 and cleaning ring 32 by the handling mechanism 50, removal of the container shells 47 by the shell knock-out member 59 at a position outside the press machine, remounting of the cleaned die and ring through utilization of the movement of the container 23 which is made for loading a fresh billet, thereby permitting continued use of the same die assembly while attaining reduction of the operational cycle time and higher efficiency. The recycling of a single die for use in the repeated extruding cycles, which is attained in a simplified manner in the present invention, is very important to preclude dimensional irregularities of the products in the extruding operation of this sort. The die recycling operations can be performed within an extremely short time period in each extruding cycle by the provision of the handling mechanism which is equipped with a shell knock-out member and which is movable to shift the die assembly between two positions in and out of the press machine, from the scraping and removal of the container shell to the remounting of the die and cleaning ring.

The continued use of one recycled die ensures uniformity in the quality of extruded products and makes it easy to improve the quality in performance and quality of products of an extrusion press, thus avoiding the necessity of the use of a number of dies of a given shape. In addition, the motions of the handling mechanism 50 are very simple so that it becomes possible to simplify the mechanism for the die recycling, which has been an important problem in indirect extrusion presses.

As is clear from the foregoing description, the present invention is applicable to a pull-back type indirect extrusion press as well as to the so-called double stem type extrusion press in which the intermediate platen is movable. Although some preferred embodiments of the invention have been described and shown, it is possible for those skilled in the art to add modifications or alterations to the particular component parts or mechanisms, and therefore it is to be understood that the present invention includes such modifications or alterations as encompassed by the appended claims.

What is claimed as new and desired to be secured by Letters Patent of the United States is:

1. An indirect extrusion press including a die assembly having a detachable loose die mounted on a die stem and axially movable relative to a billet container for extruding a billet through a die hole, and a die handling mechanism for transferring said die assembly between the press center and a retracted position outside the press machine, said indirect extrusion press comprising:

a reduced diameter portion provided in a rear end portion of said die stem and defining a stepped wall portion;

said detachable loose die mounted on an end face portion of said reduced diameter portion; and a detachable cleaning ring loosely fitted on said reduced diameter portion of said die stem in abutting engagement with said stepped wall portion and in axially spaced relation with said detachable loose die to define a gap therebetween, the detachable cleaning ring being contacted with an inner peripheral portion of said container in the extruding phase of the operation to scrape off container shells therefrom which are received in said gap, and wherein said detachable cleaning ring and said detachable loose die are adapted to cooperate with said die handling mechanism so as to be detached by said die handling mechanism from said die stem and transferred to said retracted position outside the press machine.

2. An indirect extrusion press as defined in claim 1, further comprising a knock pin disposed in a first positioning hole provided on the end face portion of said reduced diameter portion of the die stem and a second positioning hole provided in an opposing side of said detachable loose die engaging said knock pin for determining the position of said detachable loose die on said die stem.

3. An indirect extrusion press as defined in claim 1, further comprising:

said die handling mechanism provided on one side of said billet container and which further comprises a chuck member for releasably gripping said detachable loose die and cleaning ring and which is movable for transferring said detachable loose die and cleaning ring between the press center and said retracted position outside the press machine, and a knocking member movable into said gap.

4. An indirect extrusion press as defined in claim 3, wherein said die handling mechanism is movable in an axial direction of the press machine along said billet container to dismantle and remount said detachable loose die and cleaning ring at opposite ends of said billet container.

5. An indirect extrusion press as defined in claim 4, further comprising a carrier reciprocably movable in the axial direction of the press wherein said die handling mechanism further comprises a chuck mechanism movable toward and away from said press center and which is supported on said carrier reciprocably movable in the axial direction of the press to shift the axial position of said detachable loose die and cleaning ring.

6. An indirect extrusion press as defined in claim 4, wherein said die handling mechanism further comprises an arm having a clamp member at one end thereof for clamping engagement and disengagement with said detachable loose die and cleaning ring and a reciprocable rotary shaft securely connected to said arm for swinging said clamp member toward and away from said press center and movable in the axial direction of the press to shift the axial position of said detachable loose die and cleaning ring.

7. An indirect extrusion press as defined in claim 5 or 6, further comprising a closure block disposed adjacent a rear face of said billet container and movable transversely across the axis of the press and which further comprises a blind lid, a billet feeding hole and a discard billet receptacle hole positioned side-by-side in a transverse direction.

* * * * *